US011690442B1

(12) United States Patent
Jensen

(10) Patent No.: US 11,690,442 B1
(45) Date of Patent: Jul. 4, 2023

(54) ROOFING BROOM

(71) Applicant: Stephen P. Jensen, Silt, CO (US)

(72) Inventor: Stephen P. Jensen, Silt, CO (US)

( * ) Notice: Subject to any disclaimer, the term of this patent is extended or adjusted under 35 U.S.C. 154(b) by 327 days.

(21) Appl. No.: 17/066,561

(22) Filed: Oct. 9, 2020

(51) Int. Cl.

| | |
|---|---|
| ***A47L 15/00*** | (2006.01) |
| ***A46B 15/00*** | (2006.01) |
| ***A46B 5/00*** | (2006.01) |
| ***B25C 11/00*** | (2006.01) |

(52) U.S. Cl.
CPC ..... *A46B 15/0055* (2013.01); *A46B 5/0095* (2013.01); *B25C 11/00* (2013.01); *A46B 2200/302* (2013.01); *A46B 2200/405* (2013.01)

(58) Field of Classification Search
CPC ..... A46B 15/0081; A46B 2200/302; A46B 15/0055; B25C 11/00; A47L 13/12
See application file for complete search history.

(56) References Cited

U.S. PATENT DOCUMENTS

| | | | | |
|---|---|---|---|---|
| 2,056,906 A | | 10/1936 | Parkhill | |
| 3,377,641 A | | 4/1968 | McGregor | |
| 4,017,386 A | | 4/1977 | Barry | |
| 5,429,402 A | | 7/1995 | Kennedy | |
| 5,749,613 A | | 5/1998 | Rapp | |
| 5,870,794 A | * | 2/1999 | Harpell | A46B 15/0081 7/166 |
| 8,602,220 B1 | * | 12/2013 | Porter | B03C 1/284 209/418 |
| D782,203 S | * | 3/2017 | Fortier | D4/199 |
| 2012/0279520 A1 | | 11/2012 | Sarris et al. | |
| 2013/0031736 A1 | * | 2/2013 | Martin | A46B 15/0026 15/105 |

* cited by examiner

*Primary Examiner* — Shay Karls
(74) *Attorney, Agent, or Firm* — Cramer Patent & Design, PLLC; Aaron R. Cramer

(57) ABSTRACT

The broom head with nail puller attachment comprises a body, a plurality of bristles, a nail puller, and a plurality of magnets. The broom head with nail puller attachment may removably couple to a broom handle to form a broom. The broom may be operable to sweep a floor when placed into a sweeping orientation and pushed along the floor. The nail puller may be operable to remove nails from the floor when placed into a nail-pulling orientation and rotated using the broom handle to pry the nails. The plurality of magnets located within the body may be operable to collect and retain the nails or other metallic debris. In some embodiments, the body may comprise a magnet cover to protect the plurality of magnets from becoming contaminated by the metallic debris.

17 Claims, 8 Drawing Sheets

ROOFING BROOM

RELATED APPLICATIONS

Non-applicable.

FIELD OF THE INVENTION

The present invention relates to a broom and more specifically to a roofing broom.

BACKGROUND OF THE INVENTION

Anyone involved in the roofing business will tell you what a strenuous business it is. A typical day involves carrying heavy loads, enduring high temperatures and scorching sun, climbing steep roofs all the while working at dangerous elevations above ground. Anything that reduces work or allows for a better job is welcome. One part of many roofing jobs that no one enjoys is the removal of existing shingles or the "tear-off" process. Once all of the shingles are removed, it must be ensured that all nails are removed as well. This typically means crawling over the roof on one's hands and knees with a claw hammer.

Another part of the process is making sure all nails that fall to the ground are picked up from the grass and pavement areas so they do not pose a dangerous condition to those walking in the area, or if a car or lawnmower should ride over them. Finally, all debris from the room and ground must be swept up. These tasks typically require three different tools and occupy a great deal of time and labor. Accordingly, there exists a need for a means by which the above tasks of a roofing tear off can be more easily accomplished. The development of the roofing broom fulfills this need.

SUMMARY OF THE INVENTION

The principles of the present invention provide for a broom head comprises a body having a bottom surface and a top surface, a plurality of bristles coupled to the bottom surface of the body and a nail puller and a handle interface combined together. The nail puller removes one or more nails when placed into a nail-pulling orientation and is rotated using a broom handle to pry the one or more nails. The handle interface attaches the broom handle thereto and the nail puller includes a plurality of teeth located on a top edge of the nail puller. The broom head also comprises a plurality of magnets which are located within the body and are operable to collect and retain the one or more nails.

The body may have a rectangular prism shape. The bristles may be a semi-rigid filament. The bristles on the body may be of uniform length such that the bristles simultaneously touch the floor when the body is held in a sweeping orientation. The top surface of the body may include a plate having the handle interface at a first end of the plate and the nail puller at a second end of the plate. The plate may be removably affixed to the top surface of the body. The handle interface may be a threaded female coupler that may mate with a threaded male coupler that may be located on the bottom end of the broom handle.

The threaded female coupler on the body and the threaded male coupler on the broom handle may include a plurality of complementary threads such that the threaded male coupler on the broom handle may screw into the threaded female coupler on the body to retain the body on the broom handle. The complementary threads may be 3/4-5 ACME threads. The handle interface may be oriented at a handle angle which may be towards the rear of the body. The handle angle may be an oblique angle which may be measured between the top surface of the body and the broom handle. The teeth may include a plurality of notches along the top edge of the nail puller. The teeth of the nail puller may slide under a head of the one or more nails when the broom head is placed into the nail-pulling orientation. The magnets may be located within the body and may be operable to collect and retain other metallic debris. The magnets may be embedded into the top surface of the body in a forward position such that the top of the magnets are flush with the top surface of the body and the front of the magnets are flush with the front surface of the body.

The body may include a magnet cover that protects the magnets from becoming contaminated. The magnet cover may cover the front surface and the top surface of the body such that the magnets are located beneath the magnet cover. The magnet cover may be sheet metal that becomes magnetized by the magnets located beneath the magnet cover. The magnet cover may be a non-metallic covering that the magnetic field of the magnets passes through. The broom head may removably couple to the broom handle to form a broom.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
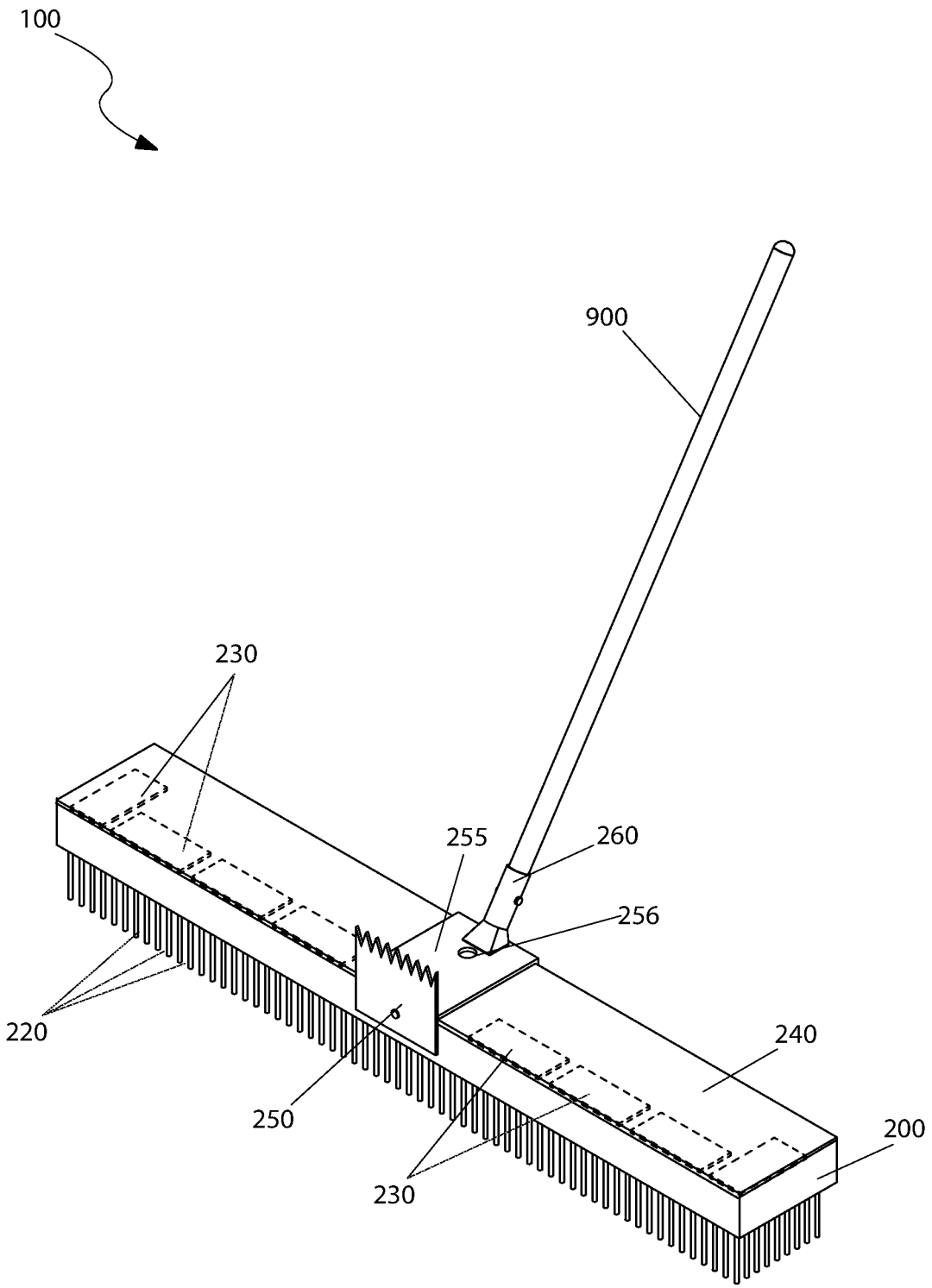
FIG. 1 is a front isometric view of a broom head with nail puller attachment, according to an embodiment of the present invention.
Figure 2:
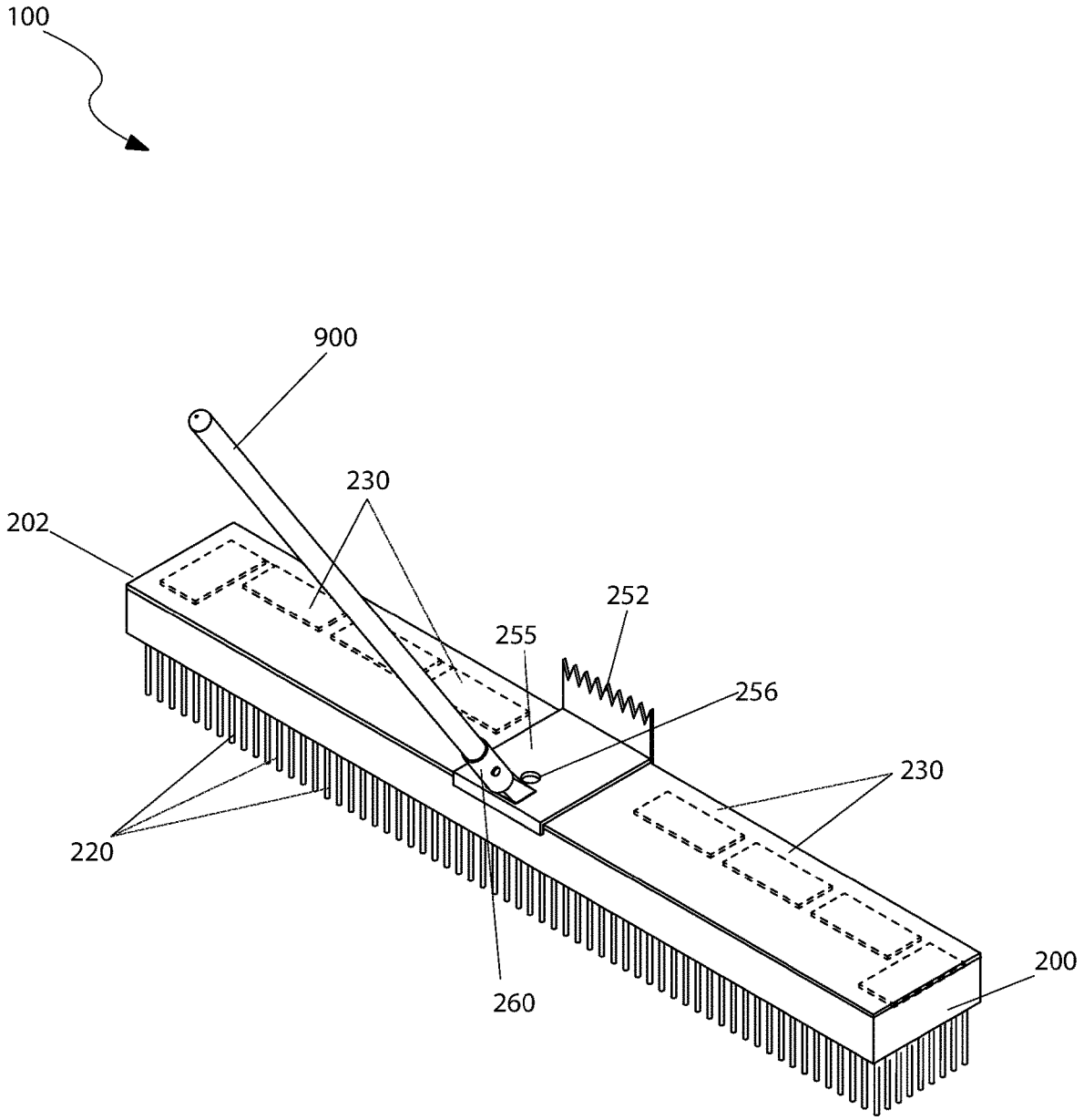
FIG. 2 is a rear isometric view of a broom head with nail puller attachment, according to an embodiment of the present invention; and, FIG. 3 is a front view of a broom head with nail puller attachment, according to an embodiment of the present invention; and, FIG. 4 is a rear view of a broom head with nail puller attachment, according to an embodiment of the present invention; and, FIG. 5 is a side view of a broom head with nail puller attachment, according to an embodiment of the present invention; and, FIG. 6 is a top view of a broom head with nail puller attachment, according to an embodiment of the present invention; and, FIG. 7 is a bottom view of a broom head with nail puller attachment, according to an embodiment of the present invention; and, FIG. 8A is an in-use view of a broom head with nail puller attachment, according to an embodiment of the present invention illustrating the motion necessary to engage the nail puller with a nail; and, FIG. 8B is an in-use view of a broom head with nail puller attachment, according to an embodiment of the present invention illustrating the motion necessary to pull the nail.
Figure 3:
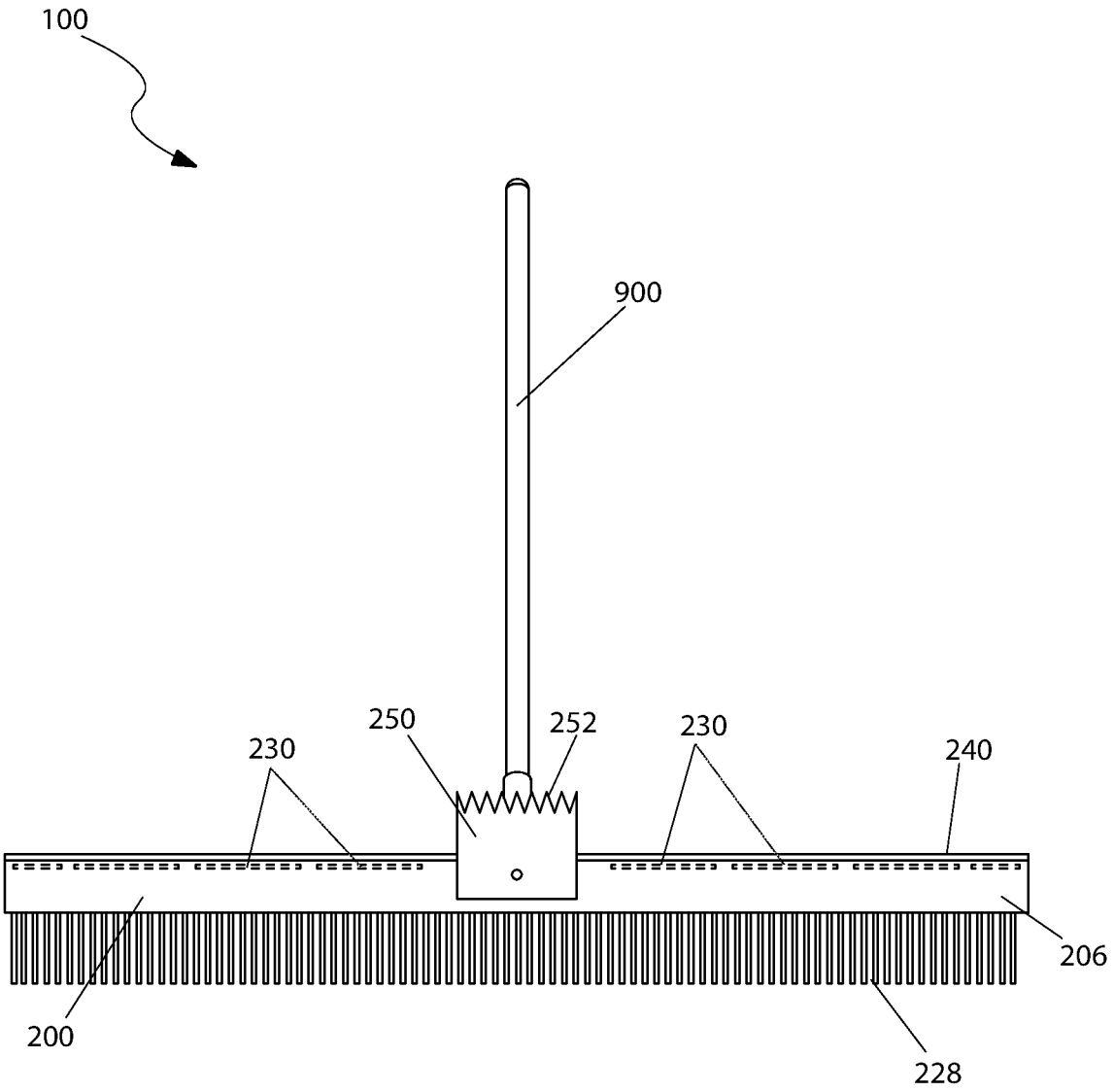
Figure 4:
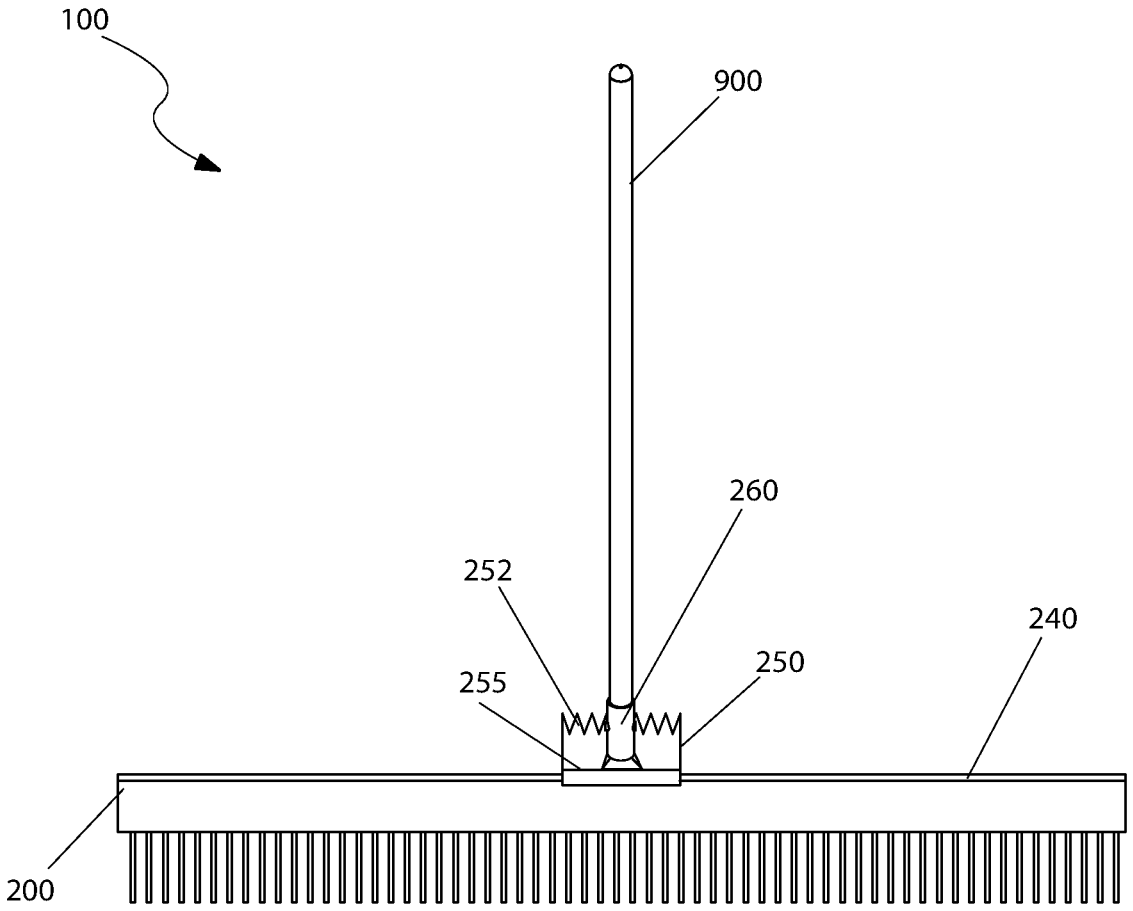

100 broom head with nail puller attachment
200 body
202 top surface
204 bottom surface
206 front surface

220 plurality of bristles
228 individual bristle
230 plurality of magnets
240 magnet cover
250 nail puller
252 plurality of teeth
255 plate
256 aperture
260 handle interface
262 threaded female coupler
268 handle angle
270 broom
290 sweeping orientation
292 nail-pulling orientation
900 broom handle
902 threaded male coupler
910 nail
912 individual nail
914 head
920 floor
950 user

DESCRIPTION OF THE INVENTION

The present invention is directed to a broom head with nail puller attachment (herein described as the "invention") 100. The invention may comprise a body 200, a plurality of bristles 220, a nail puller 250 and handle interface 260 combined in a unitary feature, and a plurality of magnets 230. The invention 100 may removably couple to a broom handle 900 to form a broom 270. The broom 270 may be operable to sweep a floor 920 when placed into a sweeping orientation 290 and pushed along the floor 920. The nail puller 250 may be operable to remove nails 910 from the floor 920 when placed into a nail-pulling orientation 292 and rotated using the broom handle 900 to pry the nails 910. The handle interface 260 enables a broom handle 900 to be attached thereto. The plurality of magnets 230 located within the body 200 may be operable to collect and retain the nails 910 or other metallic debris.

Throughout this document terminology related to positions, directions, and orientations assume that the invention 100 is oriented for sweeping with the plurality of bristles 220 resting on the floor 920 unless stated otherwise.

A bottom surface 204 of the body 200 may be coupled to the plurality of bristles 220. An individual bristle 228 selected from the plurality of bristles 220 may be a semi-rigid filament. The plurality of bristles 220 on the body 200 may be of uniform length such that the plurality of bristles 220 simultaneously touch the floor 920 when the body 200 is held in the sweeping orientation 290. The sweeping orientation 290 may refer to the orientation of the body 200 such that the bottom surface 204 of the body 200 is parallel to the floor 920. In some embodiments, the body 200 may be the shape of a rectangular prism.

Figure 5:
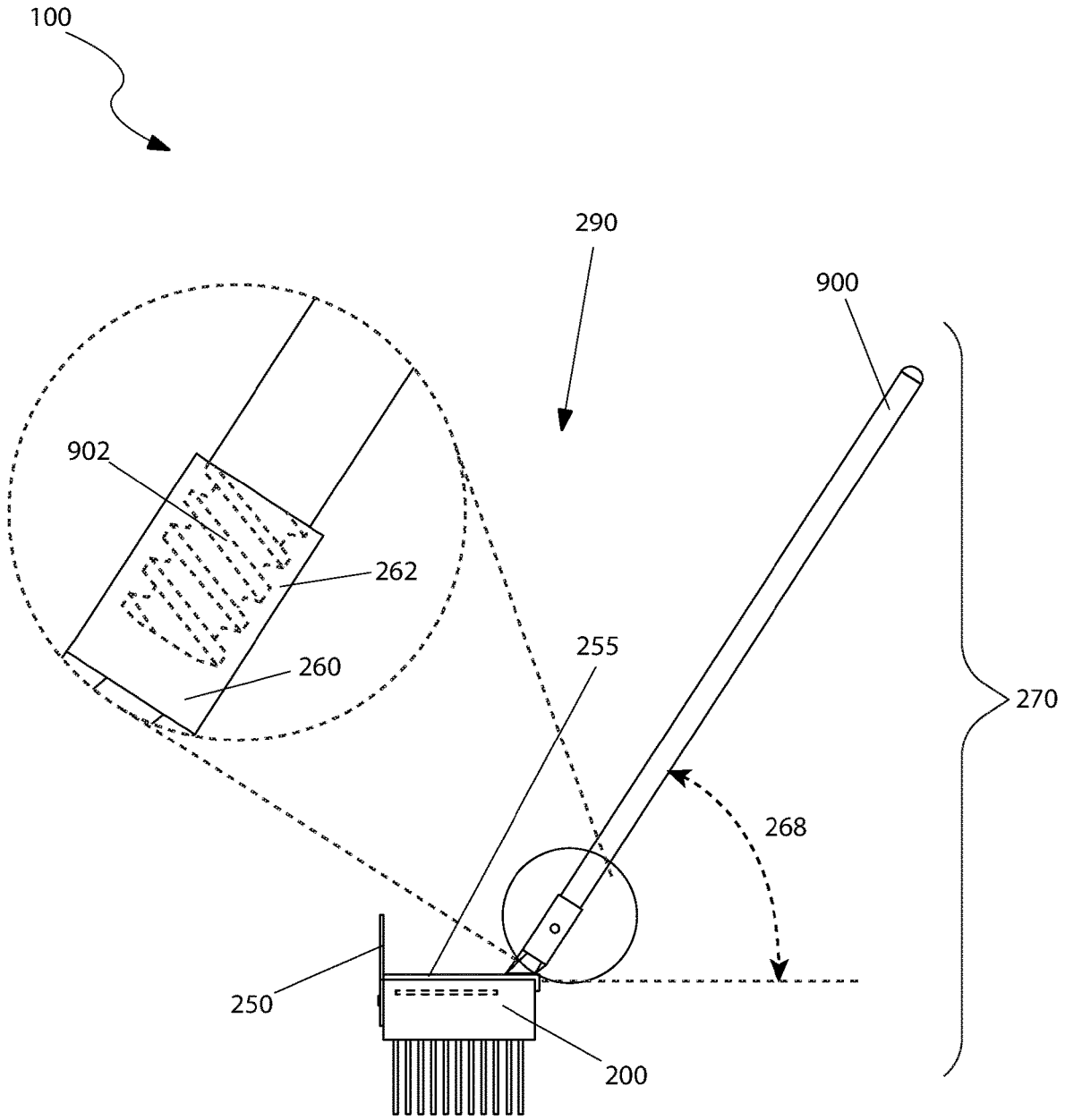
Figure 6:
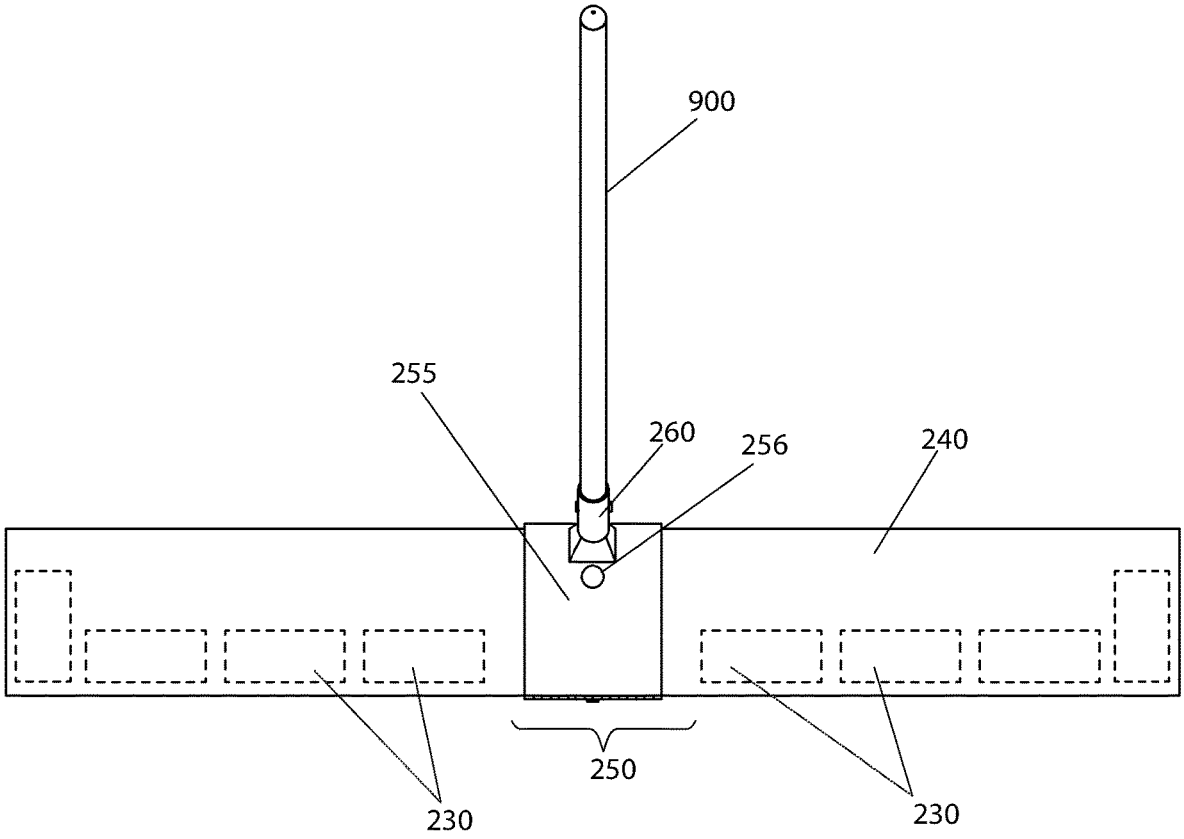
Figure 7:
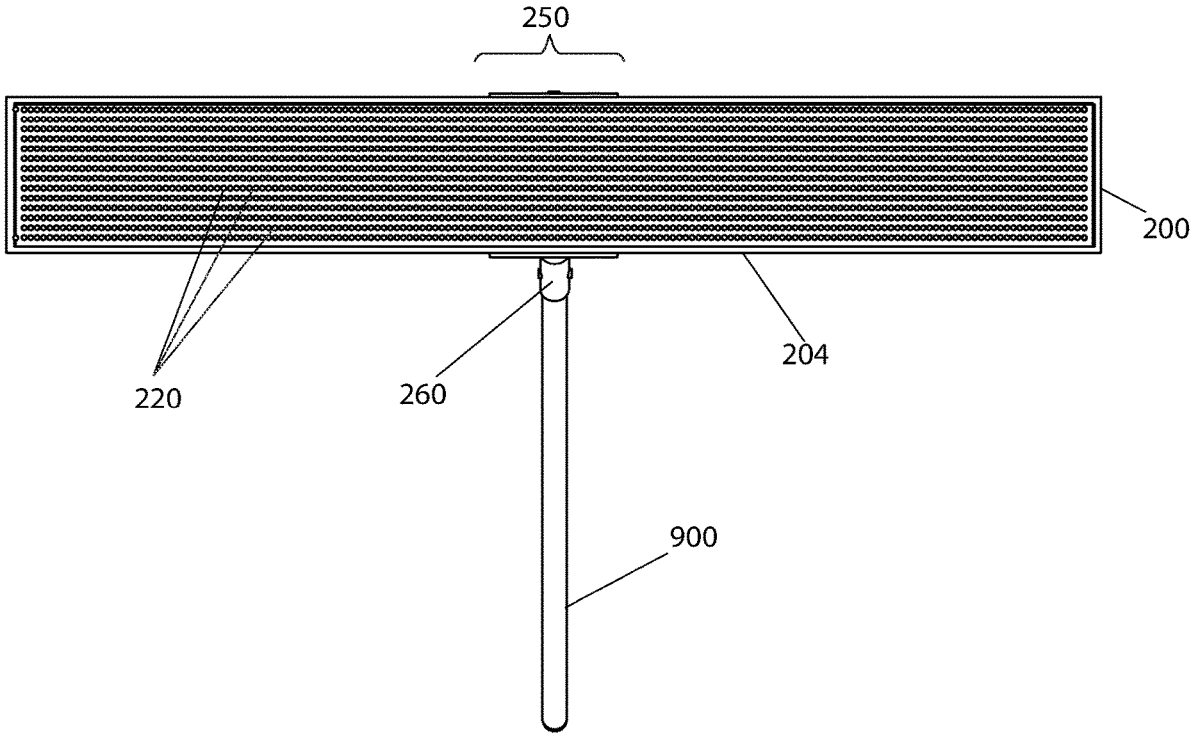

A top surface 202 of the body 200 may comprise a plate 255, having a handle interface 260 at a first end and a nail puller 250 at a second end. The plate 255 may be removably affixed to the top surface 2020 of the body 200 with a fastener (not shown) through an aperture 256. The handle interface 260 may be a threaded female coupler 262 that is operable to mate with a threaded male coupler 902 that is located on the bottom end of the broom handle 900. The threaded female coupler 262 on the body 200 and the threaded male coupler 902 on the broom handle 900 may comprise complementary threads such that the threaded male coupler 902 on the broom handle 900 may screw into the threaded female coupler 262 on the body 200 to retain the body 200 on the broom handle 900. As a non-limiting example, the complementary threads may be 3/4-5 ACME threads. The handle interface 260 may be oriented at a handle angle 268 towards the rear of the body 200. The handle angle 268 may be an oblique angle measured between the top surface 202 of the body 200 and the broom handle 900. In some embodiments, the handle angle 268 may be forty-five degrees to ten degrees (45°-10°; refer to FIG. 5.)

Figure 8A:
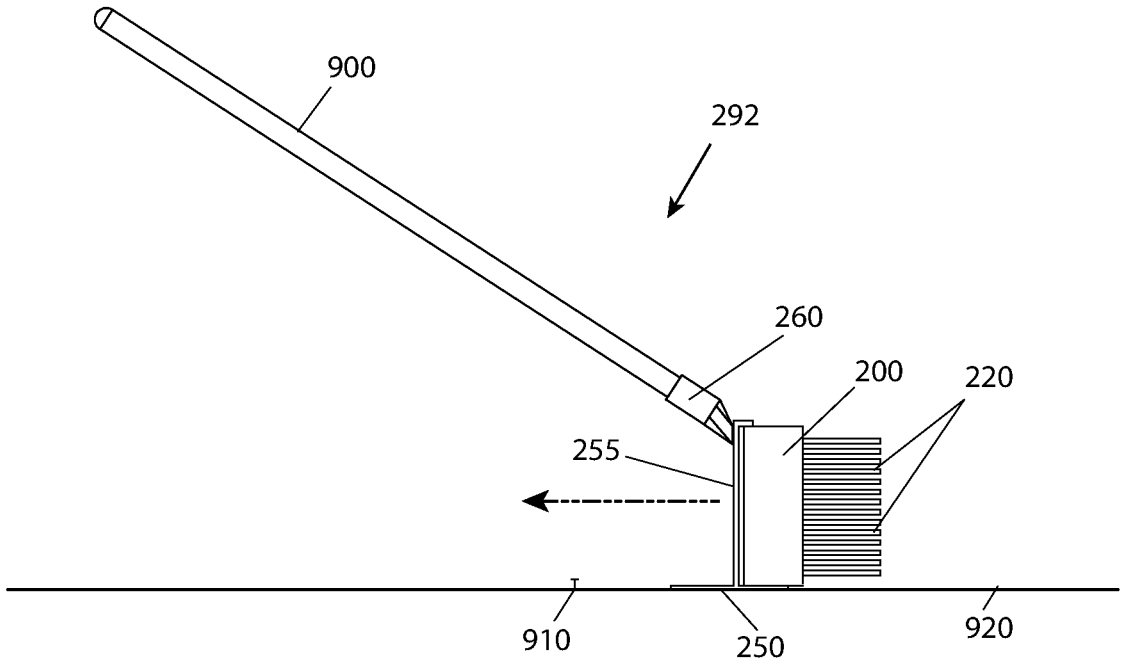
Figure 8B:
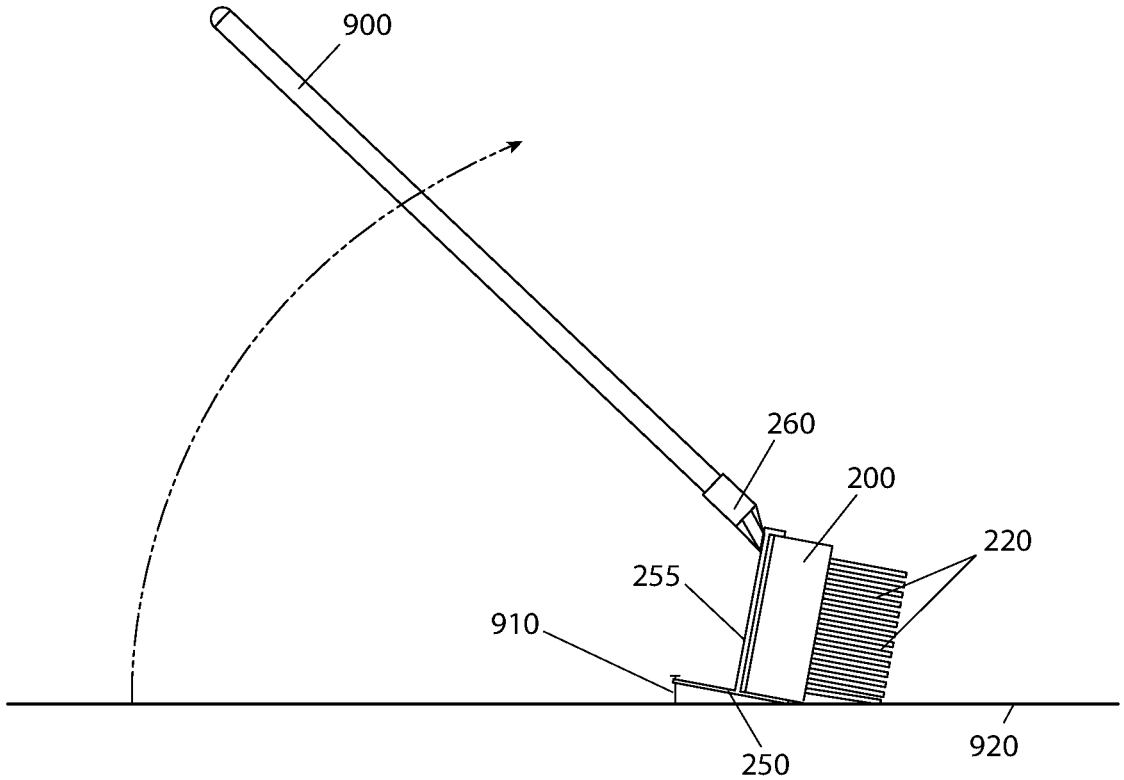

The nail puller 250 may be operable to pry one (1) or more of the nails 910 from the floor 920. The nail puller 250 may further comprise a vertically-oriented plate capable of being coupled to a front surface 206 of the body 200. The nail puller 250 may comprise a plurality of teeth 252 located on the top edge of the nail puller 250. As a non-limiting example, the plurality of teeth 252 may comprise a plurality of notches along the top edge of the nail puller 250. The plurality of teeth 252 of the nail puller 250 may slide under a head 914 of an individual nail 912 when the invention 100 is placed into the nail-pulling orientation 292 (refer to FIG. 8A.). The nail-pulling orientation 292 may refer to an orientation of the invention 100 that rotates the body 200 forward by ninety degrees (90°) such that the nail puller 250 is pressed against the floor 920. With the invention 100 in the nail-pulling orientation 292 and the plurality of teeth 252 of the nail puller 250 positioned under the head 914 of the individual nail 912, the invention 100 may be rotated rearwards by ninety degrees (90°) using the broom handle 900 to pry the individual nail 912 out of the floor 920 and to return the invention 100 to the sweeping orientation 290 (refer to FIG. 8B.)

The body 200 may comprise the plurality of magnets 230. The plurality of magnets 230 may be embedded into the top surface 202 of the body 200 in a forward position such that the top of the plurality of magnets 230 are flush with the top surface 202 of the body 200 and the front of the plurality of magnets 230 are flush with the front surface 206 of the body 200. In some embodiments, the plurality of magnets 230 may be disposed on either lateral side of the nail puller 250. The plurality of magnets 230 may be operable to collect and retain the nails 910 or the other metallic debris by rotating the invention 100 into the nail-pulling orientation 292 and pulling the body 200 along the floor 920 until the nails 910 are adjacent to the plurality of magnets 230. The nails 910 may be retained by the plurality of magnets 230 due to magnetic attraction between the nails 910 and the plurality of magnets 230 when the invention 100 is returned to the sweeping orientation 290.

In some embodiments, the body 200 may comprise a magnet cover 240. The magnet cover 240 may protect the plurality of magnets 230 from becoming contaminated by the other metallic debris. The magnet cover 240 may cover the front surface 206 and the top surface 202 of the body 200 such that the plurality of magnets 230 are located beneath the magnet cover 240. In some embodiments, the magnet cover 240 may be sheet metal that becomes magnetized by the plurality of magnets 230 located beneath the magnet cover 240. In some embodiments, the magnet cover 240 may be a non-metallic covering that the magnetic field of the plurality of magnets 230 passes through. As a non-limiting example, the magnet cover 240 may be plastic. The magnet cover 240 may be wiped clean after use to remove the nails 910 and the other metallic debris.

In some embodiments, the magnet cover 240, the nail puller 250, the plate 255, the handle interface 260, the body 200, or combinations thereof made be fabricated from a single material. As non-limiting examples, the nail puller 250, the plate 255, the magnet cover 240, and the handle interface 260 may be a single sheet of metal that is stamped and bent to shape or the body 200 and the handle interface 260 may be a single molded plastic part.

In use, the invention 100 may be removably coupled to a threaded male coupler 902 on the bottom of a broom handle 900 to form a broom 270. While the broom 270 is in a sweeping orientation 290, a plurality of bristles 220 on the bottom of a body 200 may be pulled across a floor 920 to sweep the floor 920. If a user 950 encounters a nail 910, the broom 270 may be placed in a nail-pulling orientation 292 and a plurality of teeth 252 of a nail puller 250 may be placed under a head 914 of the nail 910. Then, by pushing the broom handle 900 towards the rear, the body 200 may rotate and may lift the nail puller 250, thus pulling the nail 910. The broom 270 may be reoriented to the nail-pulling orientation 292 and a plurality of magnets 230 in the body 200 may be moved to be adjacent to the nails 910 that have been pulled. The nails 910 may collect and retain the nails 910 until the nails 910 are removed from the plurality of magnets 230 by the user 950.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A broom head, comprising:

a body having a bottom surface and a top surface;

a plurality of bristles coupled to the bottom surface of the body;

a nail puller and a handle interface combined together, the nail puller removes one or more nails when placed into a nail-pulling orientation and is rotated using a broom handle to pry the one or more nails and the handle interface attaches the broom handle thereto and the nail puller includes a plurality of teeth located on a top edge of the nail puller; and a plurality of magnets located within the body are operable to collect and retain the one or more nails; and, wherein the magnets are embedded into the top surface of the body in a forward position such that the top of the magnets are flush with the top surface of the body and the front of the magnets are flush with a front surface of the body; and, wherein a magnet cover covers the front surface of the body and the top surface of the body such that the magnets are located beneath the magnet cover.

2. The broom head, according to claim 1, wherein the body has a rectangular prism shape.

3. The broom head, according to claim 1, wherein the bristles are a semi-rigid filament.

4. The broom head, according to claim 1, wherein the bristles on the body are of uniform length such that the bristles simultaneously touch the floor when the body is held in a sweeping orientation.

5. The broom head, according to claim 1, wherein the top surface of the body includes a plate having the handle interface at a first end of the plate and the nail puller at a second end of the plate.

6. The broom head, according to claim 5, wherein the plate is removably affixed to the top surface of the body.

7. The broom head, according to claim 1, wherein the handle interface is a threaded female coupler that is mates with a threaded male coupler that is located on the bottom end of the broom handle.

8. The broom head, according to claim 7, wherein the threaded female coupler on the body and the threaded male coupler on the broom handle includes a plurality of complementary threads such that the threaded male coupler on the broom handle screws into the threaded female coupler on the body to retain the body on the broom handle.

9. The broom head, according to claim 8, wherein the complementary threads are 3/4-5 ACME threads.

10. The broom head, according to claim 1, wherein the handle interface is oriented at a handle angle towards the rear of the body.

11. The broom head, according to claim 10, wherein the handle angle is an oblique angle measured between the top surface of the body and the broom handle.

12. The broom head, according to claim 1, wherein the teeth include a plurality of notches along the top edge of the nail puller.

13. The broom head, according to claim 1, wherein the teeth of the nail puller slides under a head of the one or more nails when the broom head is placed into the nail-pulling orientation.

14. The broom head, according to claim 1, wherein the magnets located within the body are operable to collect and retain other metallic debris.

15. The broom head, according to claim 1, wherein the magnet cover is sheet metal that becomes magnetized by the magnets located beneath the magnet cover.

16. The broom head, according to claim 1, wherein the magnet cover is a non-metallic covering that the magnetic field of the magnets passes through.

17. The broom head, according to claim 1, wherein the broom head removably couples to the broom handle to form a broom.

* * * * *